US006561930B2

(12) United States Patent
Mabry

(10) Patent No.: US 6,561,930 B2
(45) Date of Patent: May 13, 2003

(54) TRAINING BALL BAT

(76) Inventor: Kenneth A. Mabry, 1416 Spring Dr., Rock Hill, SC (US) 29730

( * ) Notice: Subject to any disclaimer, the term of this patent is extended or adjusted under 35 U.S.C. 154(b) by 0 days.

(21) Appl. No.: 09/788,230

(22) Filed: Feb. 16, 2001

(65) Prior Publication Data

US 2002/0151389 A1 Oct. 17, 2002

(51) Int. Cl.[7] ..... A63B 69/00; A63B 59/00; A63B 59/06

(52) U.S. Cl. ..... 473/457; 473/564

(58) Field of Search ..... 473/564–568, 473/457, 519, FOR 101, FOR 168, FOR 169, 415, 422, 451, 453, 463, 559; 463/47.1–47.7

(56) References Cited

U.S. PATENT DOCUMENTS

| | | | | |
|---|---|---|---|---|
| 2,135,648 A | | 11/1938 | Stumpf | |
| 2,470,816 A | | 5/1949 | Harvey | |
| 3,136,546 A | | 6/1964 | Connolly | |
| 3,414,260 A | * | 12/1968 | Gust | 473/463 |
| 3,433,481 A | | 3/1969 | Tanguay | |
| 3,521,883 A | | 7/1970 | Hamilton | |
| 3,623,724 A | | 11/1971 | Lande | |
| 3,897,068 A | | 7/1975 | Staples | |
| 4,098,503 A | * | 7/1978 | Antone | 294/168 XZ |
| 4,260,150 A | | 4/1981 | Tabet | |
| 4,373,718 A | | 2/1983 | Schmidt | |
| 4,423,868 A | | 1/1984 | Younts | |
| 5,011,145 A | | 4/1991 | Bartkowicz | |
| 5,014,984 A | | 5/1991 | Brockhoff | |
| 5,024,436 A | | 6/1991 | Vento | |
| 5,050,877 A | | 9/1991 | Wales | |
| 5,100,136 A | | 3/1992 | Chen | |
| 5,360,209 A | * | 11/1994 | Mollica | 473/457 |
| 5,395,107 A | | 3/1995 | De Pippo | |
| 5,456,461 A | | 10/1995 | Sullivan | |
| 5,582,407 A | * | 12/1996 | Sorenson | 473/256 XZ |
| 5,653,664 A | * | 8/1997 | Jennings | 473/256 XZ |
| 5,711,728 A | | 1/1998 | Marcelo | |
| 6,050,908 A | * | 4/2000 | Muhlhausen | 473/457 XZ |

* cited by examiner

*Primary Examiner*—Paul T. Sewell
*Assistant Examiner*—Mitra Aryanpour
(74) *Attorney, Agent, or Firm*—Adams, Schwartz & Evans, P.A.

(57) ABSTRACT

A training bat including a handle having proximal and distal ends with a diameter of a conventional baseball bat and an elongate ball-striking element having proximal and distal ends. The ball-striking element is secured to the handle by the proximal end and extends outwardly from the distal end of the handle. The ball-striking element has a diameter no greater than one-half the diameter of a conventional baseball bat for providing a training effect as the bat is used to swing at a ball pitched to a batter using the training bat. Weights may be removed and added as desired to change the weight. The weights are positioned near the center of the bat in order to maintain the proper balance of the bat.

14 Claims, 4 Drawing Sheets

TRAINING BALL BAT

TECHNICAL FIELD AND BACKGROUND OF THE INVENTION

This invention relates to a training bat for use by baseball and softball players for improving hand/eye coordination during batting activity. In general, the training bat operates by training the batter to hit a ball, which may the same size or smaller than regulation, with a smaller diameter bat. When the batter later uses a regulation wooden or aluminum bat during play, greater accuracy in putting the bat on the ball is achieved. Notwithstanding the smaller diameter of the ball-striking portion of the bat, the bat is generally the same weight and length as conventional bats.

Conventional ball bats are identified by weight, length and a number which correlates these two numbers. For example, a typical bat length is 31 inches, and a typical bat weight is 28 oz. Such a bat is referred to as a "−3" bat, by subtracting the length in inches from the weight in ounces. (28 minus 31=−3). Bats can be made lighter or heavier for a given length. Thus, a 31 inch bat which weights 31 oz. is referred to as a "0" bat, whereas a 31 inch bat which weighs 25 oz. is referred to as a "−6" bat. These sizes and relationships are critical to fitting a bat to an individual player so that the player achieves optimal results, taking into account player age, size, strength, experience and the like.

The training bat disclosed and claimed in this application is designed to be alterable so as to achieve the same relationship between weight and length as is present in conventional wooden or aluminum bats used during regulation play. By doing this, the training effect achieved by using the bat is enhanced.

SUMMARY OF THE INVENTION

Therefore, it is an object of the invention to provide a training bat which simulates a conventional wooden or aluminum bat in weight, length and balance.

It is another object of the invention to provide a training bat which can be varied in weight to achieve a particular weight to length ratio without affecting the balance of the bat.

It is another object of the invention to provide a training bat which is an effective training aid.

It is another object of the invention to provide a training bat which can be used to practice in a small area.

It is another object of the invention to provide a training bat which is safe for use by players of various skill and training levels.

It is another object of the invention to provide a training bat which is easily weight adjustable.

These and other objects of the present invention are achieved in the preferred embodiments disclosed below by providing a training bat comprising a handle having proximal and distal ends with a diameter of a conventional baseball bat, and an elongate ball-striking element having proximal and distal ends. The ball-striking element is secured to the handle by the proximal end and extends outwardly from the distal end of the handle. The ball-striking element has a diameter no greater than one-half the diameter of a conventional baseball bat for providing a training effect as the bat is used to swing at a ball pitched to a batter using the training bat.

According to one preferred embodiment of the invention, the combined length of the handle and ball-striking element extending outwardly from the handle is equivalent to the length of a conventional bat used by the batter during a game.

According to another preferred embodiment of the invention, the weight of the training bat is equivalent to the weight of a conventional bat used by the batter during a game.

According to yet another preferred embodiment of the invention, the bat includes a weight assembly positioned adjacent the distal end of the handle and the proximal end of the ball-striking element for permitting the weight of the bat to be adjusted to a desired training weight.

According to yet another preferred embodiment of the invention, the weight assembly comprises at least one weight having a hole therein for placement of the weight onto the ball-striking element, and a lock for locking the weight on the ball-striking element.

According to yet another preferred embodiment of the invention, the weight assembly comprises a plurality of weights, each having a hole therein for being selectively placed on and removed from the ball-striking element as desired to change the weight of the bat, and a groove in the ball-striking element between the weight closest to the distal end of the ball-striking element, for receiving a locking clip therein for locking the weights on the ball-striking element.

According to yet another preferred embodiment of the invention, the bat includes a resilient spacer for accommodating space between the weights and the handle.

According to yet another preferred embodiment of the invention, the handle includes a looped hand strap attached to the proximal end thereof for being looped over the hand of the batter for preventing the bat from being inadvertently thrown if released by the batter.

According to yet another preferred embodiment of the invention, the bat includes an axially-extending hole in the distal end of the handle for receiving a portion of the proximal end of the ball-striking element therein, and a pin extending radially through one side of the handle and completely through the ball-striking element within the hole for securing the handle and the ball-striking element together as a unit.

According to yet another preferred embodiment of the invention, the bat includes an enlarged tip on the distal end of the ball-striking element.

According to yet another preferred embodiment of the invention, screw threads are formed on the distal end of the ball-striking element and an enlarged tip is provided having a bore therein with complementary screw threads on the interior walls thereof for releasably securing the tip to the ball-striking element.

According to yet another preferred embodiment of the invention, a training bat is provided and comprises a handle having proximal and distal ends with a diameter of a conventional baseball bat, and an elongate ball-striking element having proximal and distal ends. The ball-striking element is secured to the handle by the proximal end and extends outwardly from the distal end of the handle. The ball-striking element has a diameter no greater than one-half the diameter of a conventional baseball bat for providing a training effect as the bat is used to strike at a ball pitched to a batter using the training bat. The combined length of the handle and ball-striking element extending outwardly from the handle is equivalent to the length of a conventional bat used by the batter during a game. The weight of the training bat is equivalent to the weight of a conventional bat used by the batter during a game. A weight assembly is positioned adjacent the distal end of the handle and the proximal end of the ball-striking element for permitting the weight of the bat to be adjusted to a desired training weight.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
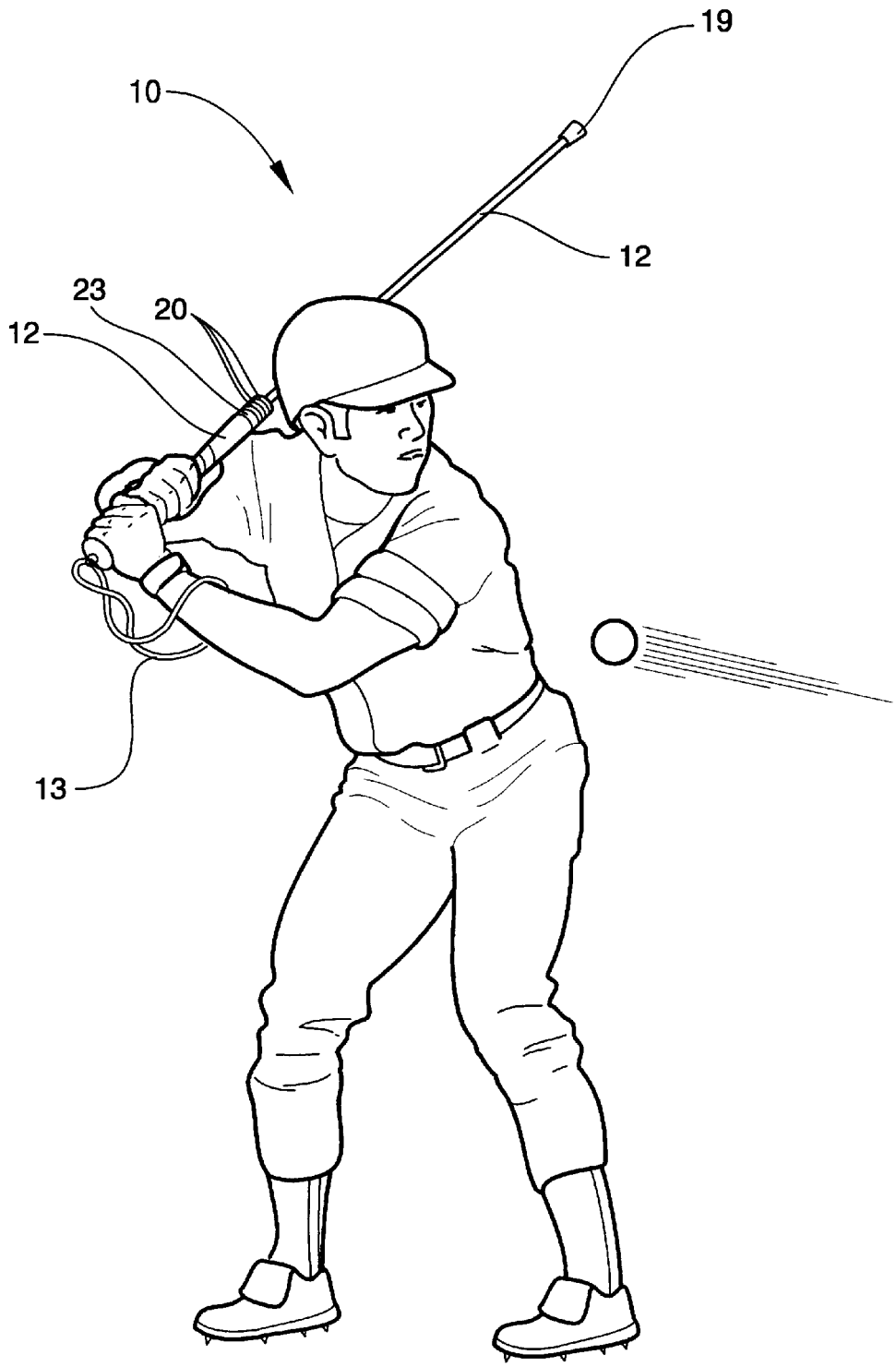
FIG. 1 is an environmental view of a training bat in use by a player.

Referring now specifically to the drawings, a training bat according to the present invention is illustrated in FIG. 1 and shown generally at reference numeral 10. The training bat 10 is designed to be the same weight, length and balance as the bat the player would ordinarily use during regulation play. The training bat is comprised of two principal elements, a handle 11 and a ball-striking element 12. A looped hand strap 13 is attached to the end of the handle 11. By extending the lowermost hand of the player through the strap 13, the training bat 10 is prevented from being inadvertently thrown by the player should he lose his grip during a swing.

Figure 2:
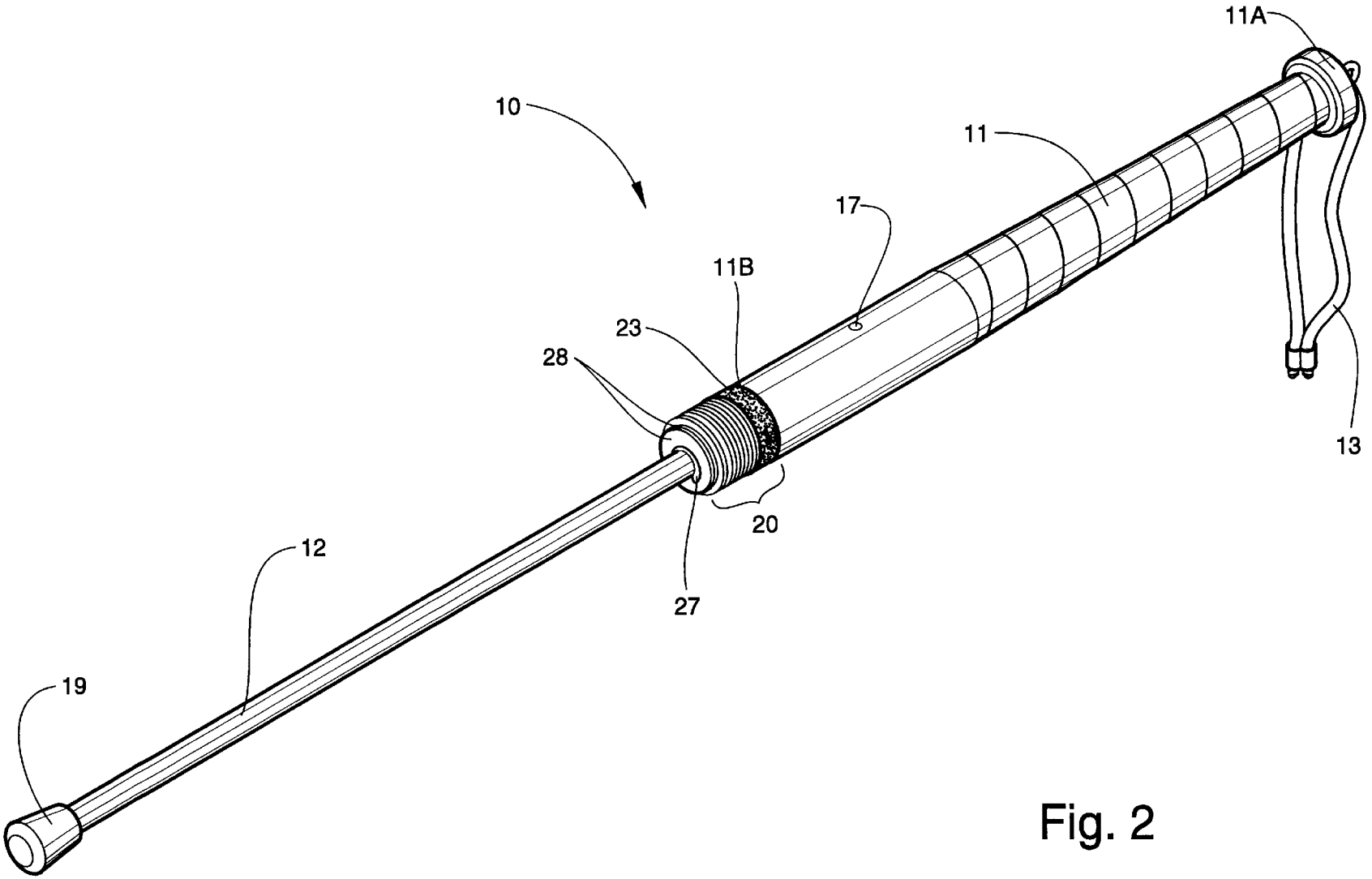
FIG. 2 is a perspective view of a training bat according to a preferred embodiment of the invention.
Figures 3, 4:
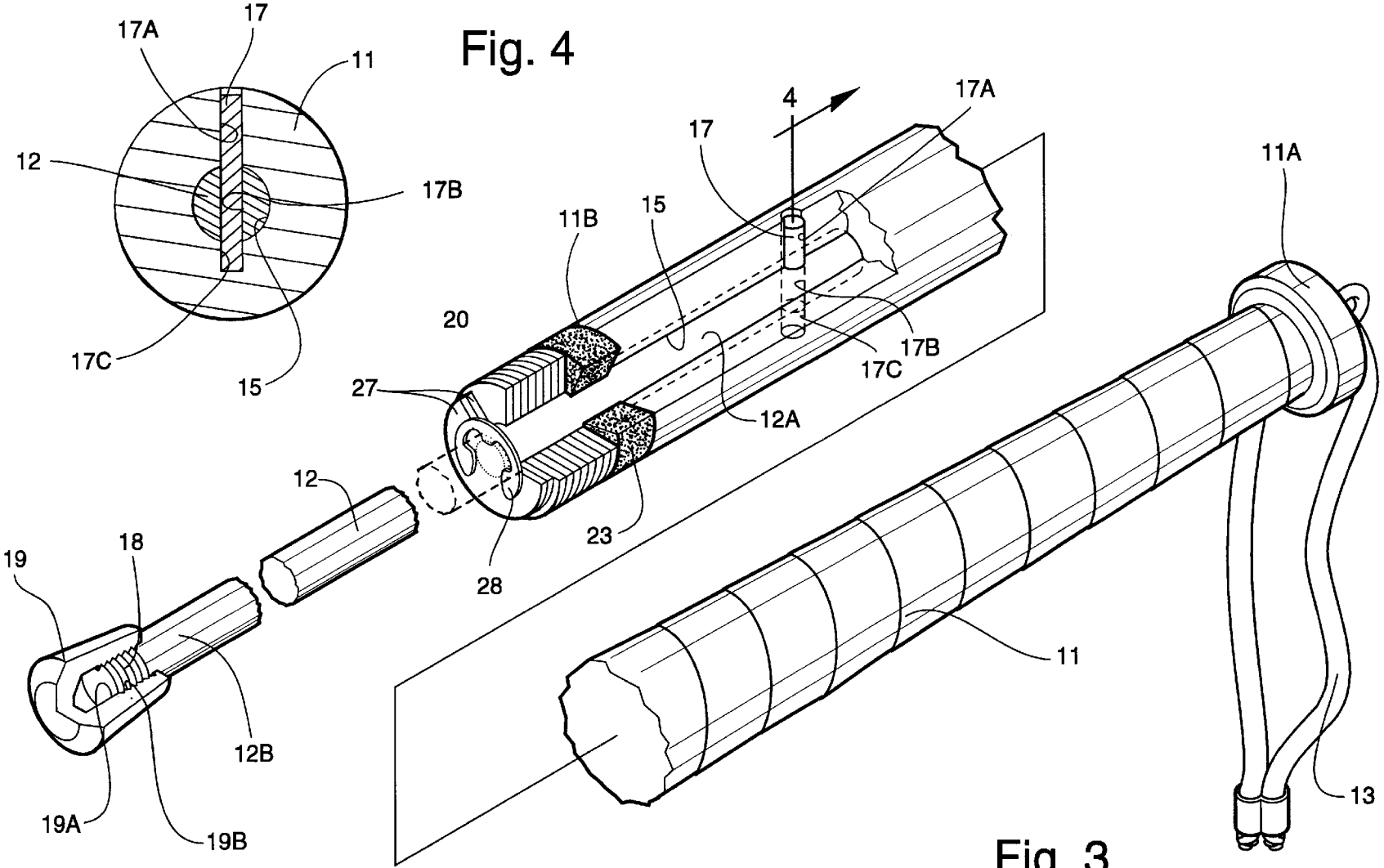
FIG. 3 is a vertical cross-sectional view of the bat through the pin which locks the handle and ball-striking element together.
FIG. 4 is an enlarged perspective view of the training bat shown in FIG. 2 with parts broken away.

Referring now to FIGS. 2 and 3, the handle 11 is preferably formed of aluminum or wood and shaped to duplicate the size and feel of a conventional bat. The handle 11 may be wrapped with tape to improve the grip, also as in conventional bats. The opposite ends of the handle 11 are defined as a proximal end 11A and a distal end 11B.

The ball-striking element 12 is secured to the handle 11 by a proximal end 12A extending outwardly from a axially-extending bore 15 in the distal end 11B of the handle 11. The ball-striking element 12 is preferably constructed of solid zinc-plated steel or aluminum and is secured into the bore 15 by a suitable adhesive such as an epoxy, and by a pin 17 which extends radially through a bore 17A in one side of the handle 11, a mating bore 17B in the ball-striking element 12 and a bore 17C which extends only partially through the other side of the handle 11. See FIG. 4. This prevents the pin 17 from being either accidentally or deliberately pushed out one side of the handle 11 by pressure on the opposite side.

The diameter of the ball-striking element 12 is substantially less than the diameter of a conventional bat. The distal end 12B of the ball-striking element 12 preferably includes threads 18, and receives an enlarged blunt tip 19 of rubber or plastic which has a bore 19A with mating threads 19B formed therein. This provides an added measure of safety by preventing a puncture in the event that someone is hit with the distal end 12B of the ball-striking element 12.

Figure 5:
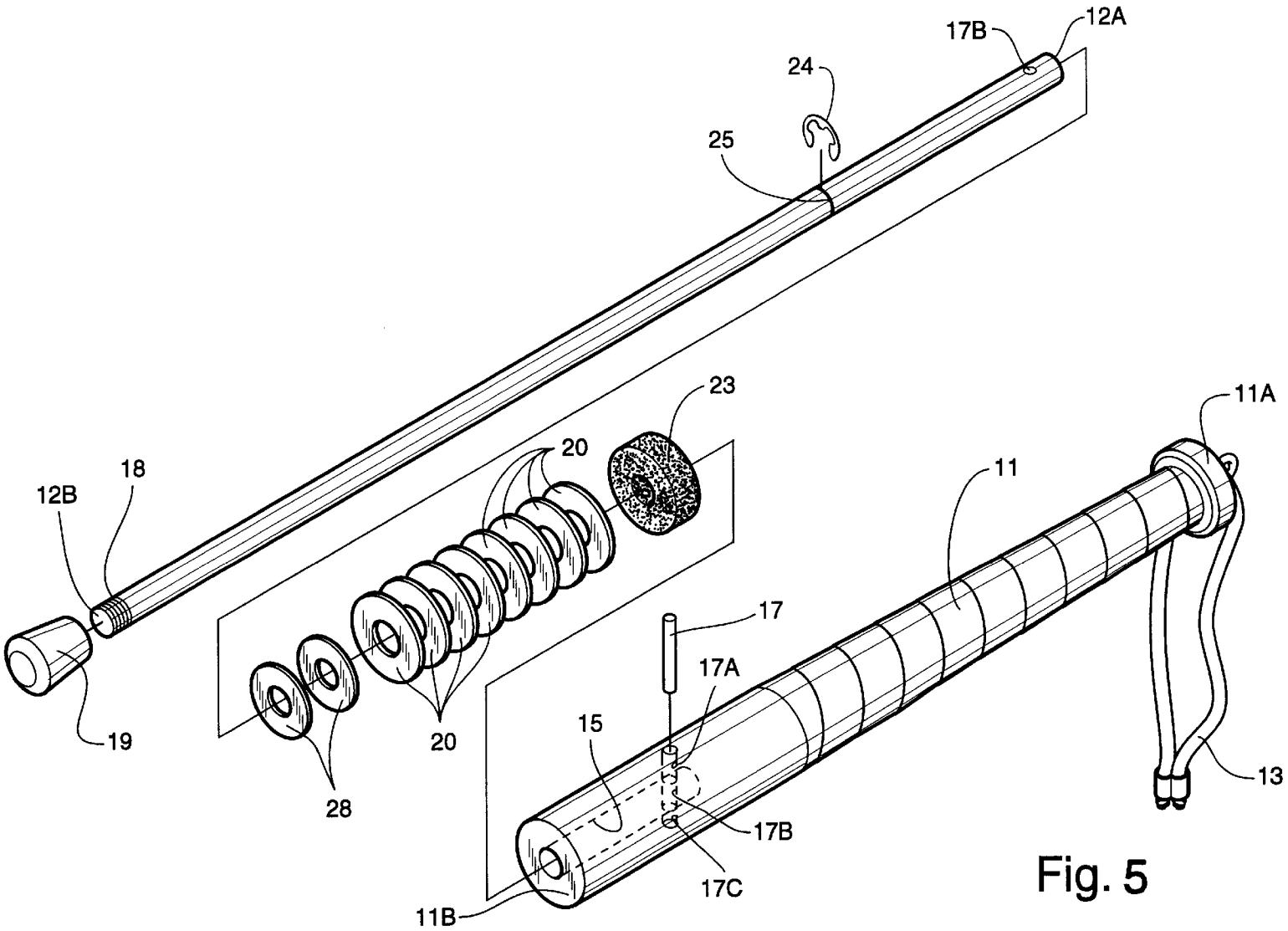
FIG. 5 is an exploded perspective view of the training bat shown in FIGS. 1–4.

Referring now to FIG. 5, weight and balance of the training bat 10 is adjusted by adding or removing individual weights 20. Weights 20, preferably in the shape of washers, are placed on the ball-striking element 12 by removing the tip 19 and sliding the desired number of weights down the length of the ball-striking element 12 towards the distal end 11B of the handle 11. Preferably, each weight weighs ½ oz. Placement of the weights 20 near the center of the training bat 10 maintains the balance of the bat more precisely and with less variation than if the weights were placed nearer either end.

A foam or other resilient split spacer 23 prevents movement of the weights 20 when properly installed on the ball-striking element 11. The ball-striking element 12 includes a peripheral groove 25 adapted to receive a lock, such as an "E-clip" 27. The distance between the groove 25 and the distal end 11B of the handle 11 defines the maximum space available for accommodating the weights 20. The spacer 23 accommodates excess space when less than the maximum number of weights 20. One or more plastic spacers 28 can be used to take up additional space, if necessary.

The weight of the training bat 10 is reduced by reversing the steps described above.

One preferred embodiment of the ball-striking element 10 has the following dimensions and characteristics:

| | |
|---|---|
| Overall length of bat 10 | 31 inches |
| Weight of bat 10 | 28 oz. |
| Length of handle 11 | 14 inches |
| Total length of ball-striking element 12 | 21.125 inches |
| Exposed length of ball-striking element 12 | 17 inches |
| Diameter of ball-striking element 12 | ½ inch |
| Diameter of pin 17 | ⅛ inch |

Given the much smaller diameter of the ball-striking element 12 compared with the diameter in the hitting zone of a conventional bat, a training effect can be achieved by practicing hitting a smaller ball, for example, a ball approximately the size of the core of a conventional baseball, or about 2 inches.

Bad contact between the ball-striking element 12 and the smaller ball will often result in good contact with a regulation baseball. A near or complete miss with the ball-striking element 12 and the smaller ball often results in at least some contact with a regulation baseball.

A training bat is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A training bat having a weight and balance replicating a conventional bat, comprising:

(a) a handle having proximal and distal ends with a diameter of a conventional baseball bat;

(b) an elongate ball-striking element having proximal and distal ends, said ball-striking element secured to said handle by the proximal end and extending outwardly from the distal end of the handle, said ball-striking element having a diameter no greater than one-half the diameter of a conventional baseball bat for allowing a user of the bat to than one-half the diameter of a conventional baseball bat for allowing a user of the bat to practice hitting a ball with a margin of error less than that of hitting with a conventional bat;

(c) a weight assembly positioned at the junction of the distal end of the handle and the proximal end of the ball-striking element for permitting the weight of the bat to be adjusted to a desired training weight while maintaining a constant balance to attain a bat-like sensation, wherein said weight assembly comprises:

(i) a plurality of weights, each having a hole therein for being selectively placed on and removed from the ball-striking element as desired to change the weight of the bat, and (ii) a groove in the ball-striking element between the weight closest to the distal end of the ball-striking element, for receiving a locking clip therein for locking the weights on the ball-striking element; and (d) a resilient spacer for accommodating space between the weights and the handle.

2. A training bat according to claim 1, wherein the combined length of the handle and ball-striking element extending outwardly from the handle are equivalent to the length of a conventional bat used by the batter during a game.

3. A training bat according to claim 1, wherein the weight of the training bat is equivalent to the weight of a conventional bat used by the batter during a game.

4. A training bat according to claim 1, wherein said weight assembly further comprises a lock for locking the weight on the bail-striking element.

5. A training bat according to claim 1, wherein said handle includes a looped hand strap attached to the proximal end thereof for being looped over the hand of the batter for preventing the bat from being inadvertently thrown if released by the batter.

6. A training bat according to claim 1, and including an axially-extending hole in the distal end of the handle for receiving a portion of the proximal end of the ball-striking element therein, and a pin extending through one side of the handle and completely through the ball-striking element within the hole for securing the handle and the ball-striking element together as a unit.

7. A training bat according to claim 1, and including an enlarged tip on the distal end of the ball-striking element.

8. A training bat according to claim 1, and including screw threads formed on the distal end of the ball-striking element and an enlarged tip having a bore therein with complementary screw threads on the interior walls thereof for realizable securing the tip to the ball-striking element.

9. A training bat having a weight and balance replicating a conventional bat, comprising:

(a) a handle having proximal and distal ends with a diameter of a conventional baseball bat;

(b) an elongate ball-striking element having proximal and distal ends, said ball-striking element secured to said handle by the proximal end and extending outwardly from the distal end of the handle, said ball-striking element having a diameter no greater than one-half the diameter of a conventional baseball bat for allowing a user of the bat to practice hitting a ball with a margin of error less than that of hitting with a conventional bat;

(c) wherein the combined length of the handle and ball-striking element extending outwardly from the handle is equivalent to the length of a conventional bat used by the batter during a game;

(d) wherein the weight of the training bat is equivalent to the weight of a conventional bat used by the batter during a game; and (e) including a weight assembly positioned adjacent the distal end of the handle and the proximal end of the ball-striking element for permitting the weight of the bat to be adjusted to a desired training weight, wherein said weight assembly comprises:

(i) a plurality of weights, each having a hole therein for being selectively placed on and removed from the ball-striking element as desired to change the weight of the bat, (ii) a groove in the ball-striking element between the weight closest to the distal end of the ball-striking element, for receiving a locking clip therein for locking the weights on the ball-striking element, and (iii) a resilient spacer for accommodating space between the weights and the handle.

10. A training bat according to claim 9, wherein said weight assembly further comprises a lock for locking the weight on the ball-striking element.

11. A training bat according to claim 9, wherein said handle includes a looped hand strap attached to the proximal end thereof for being looped over the hand of the batter for preventing the bat from being inadvertently thrown if released by the batter.

12. A training bat according to claim 9, and including an axially-extending hole in the distal end of the handle for receiving a portion of the proximal end of the ball-striking element therein, and a pin extending through one side of the handle and completely through the ball-striking element within the hole for securing the handle and the ball-striking element together as a unit.

13. A training bat according to claim 9, and including an enlarged tip on the distal end of the ball-striking element.

14. A training bat according to claim 9, and including screw threads formed on the distal end of the ball-striking element and an enlarged tip having a bore therein with complementary screw threads on the interior walls thereof for realizable securing the tip to the ball-striking element.

* * * * *

UNITED STATES PATENT AND TRADEMARK OFFICE

CERTIFICATE OF CORRECTION

PATENT NO. : 6,561,930 B2
DATED : May 13, 2003
INVENTOR(S) : Mabry, Kenneth A.

It is certified that error appears in the above-identified patent and that said Letters Patent is hereby corrected as shown below:

Column 3,
Line 16, replace the paragraph beginning with FIG. 3 and ending with "together;" with
-- FIG. 3 is an enlarged perspective view of the training bat shown in FIG. 2 with parts broken away; --
Line 19, replace the paragraph beginning with FIG. 4 and ending with "away; and" with
-- FIG. 4 is a vertical cross-sectional view of the bat through the pin which locks the handle and ball-striking element together; and --

Signed and Sealed this

Ninth Day of September, 2003

JAMES E. ROGAN
*Director of the United States Patent and Trademark Office*